United States Patent [19]

Schuh et al.

[11] Patent Number: 4,653,598

[45] Date of Patent: Mar. 31, 1987

[54] DRAINHOLE DRILLING ASSEMBLY WITH ORIENTED ELLIPTIC DRILL COLLAR

[75] Inventors: Frank J. Schuh, Dallas; David D. Hearn, Richardson, both of Tex.

[73] Assignee: Atlantic Richfield Company, Los Angeles, Calif.

[21] Appl. No.: 674,377

[22] Filed: Nov. 23, 1984

[51] Int. Cl.[4] ..... E21B 7/08

[52] U.S. Cl. ..... 175/75; 175/61; 175/325

[58] Field of Search ..... 175/73–75, 175/61, 320, 325

[56] References Cited

U.S. PATENT DOCUMENTS 4,307,786 12/1981 Evans ..... 175/61 X 4,428,441 1/1984 Dellinger ..... 175/325

*Primary Examiner*—Stephen J. Novosad

*Assistant Examiner*—Thuy M. Bui

*Attorney, Agent, or Firm*—M. David Folzenlogen; Michael E. Martin

[57] ABSTRACT

In deep drainhole drilling, a specially oriented drill collar of generally elliptic cross section is combined with a drill bit, a downhole motor and means adapted to deflect the bit to drill the build section of the drainhole curving at a medium angle of 2° to 50° per hundred feet. Preferably, the drill collar is at least twenty feet long. The elliptic drill collar is oriented in a manner such that the minor axis of the ellipse lies generally in the direction of the intended curve of the build interval. For the desired vertical build, this places the locus of the minimum axis of the ellipse toward the vertical and the locus of major axis toward the horizontal when the curved interval of the drainhole approaches horizontal. Preferably, the minor axis is at least twenty percent shorter than the major axis. An elliptic drill collar combined and oriented in this manner will produce significant torsional resistance because the bending moment required to deflect the collar about its minimum axis is significantly less than with a collar deflected about its major axis. This stabilizes the orientation of the assembly during drilling operations. The minor axis may be misaligned with direction of build to generate forces to counteract drill motor reactions. The deflecting means may be a bent motor housing, a bent sub, a bent elliptic drill collar or any other suitable deflecting means.

34 Claims, 5 Drawing Figures

DRAINHOLE DRILLING ASSEMBLY WITH ORIENTED ELLIPTIC DRILL COLLAR

BACKGROUND OF THE INVENTION

This invention pertains to drilling the curved build section of a drainhole from a generally vertical section of a wellbore. More paticularly, this invention relates to a drainhole drilling assembly with an elliptic drill collar oriented in the vertical plane to produce significant torsional resistance to rotation.

In the art of producing hydrocarbonaceous substances such as crude oil from subsurface formations, drainholes are used in various ways to increase production. Drainholes are wellbores that deviate from a generally vertical or a generally vertically oriented slanted wellbore toward a more generally horizontal direction. Drainholes have a curved or build section in which the borehole is turned from the vertical direction toward the horizontal direction until the desired more horizontal direction is reached. Thereafter, a straighter more stabilized section is drilled, for example, a section of much larger radius of curvature. Drainhole wellbores may include more than one curved and more than one stablilized section deviating from the same vertical wellbore. Drainholes may also include deviations from the stabilized section and one or more curved build intervals. Drainholes may also include dropping sections or intervals. This disclosure pertains primarily to a system for drilling the build section of a drainhole.

Various assemblies or systems have been proposed for developing and drilling the curved build section of a drainhole. For example, U.S. Pat. No. 3,398,804 describes a system comprised of knuckle joint sections, a reamer and a drill bit. The initial deflection and direction of the curved build interval is controlled by a deflecting tool or whipstock which in combination with the knuckle joints and forces on the drilling assemblege causes the drill bit to cut into the wall of the borehole, thereby tilting the common bit-reamer axis from the axis of the wellbore. As drilling is continued, the wellbore curves in the desired direction. In this patent, torque is applied to the reamer and bit by rotation of the drill string. In this invention, a conventional downhole motor turns the bit.

The wellbore curvature is commonly stated in terms of degrees per foot. U.S. Pat. No. 3,398,804 and conventional downhole motor drainhole drilling systems refer to large angles of build. For example, U.S. Pat. No. 3,398,804 addresses angles from 0.2° per foot to 20° per foot with 10° to 12° per foot being preferred. This is a radius of about 4 to 6 feet. This invention refers to medium angles of build of 0.5° or less per foot with angles less than 0.2° per foot being preferred.

Other types of drainhole drilling systems also use downhole motors to turn the bit and a bent sub or a bent housing to generate the desired wellbore curvature. Downhole motors and their housings vary in length, but the overall length rarely exceeds 34 feet. Prior art systems using a downhole motor to drill a drainhole refer to relatively shallow wells with only a very few thousand feet of drill pipe involved. These systems concern build intervals with large angles of build. The curved section of the wellbore is near the top of the hole. Downhole motors produce torque forces on the drill string. When the curved interval of the drainhole is near the top of the hole, it is not too difficult to select an orientation from the top of the drill string that provides for the required torsional rotation of the drill string due to the torque produced while drilling with a downhole motor. The accuracy of this selection governs whether the build assembly builds in the intended direction or also produces a curve in the horizontal plane either to the right or left of the intended target. With only a very few thousand feet of drill pipe involved, conventional prior art downhole motor systems produce good results even though the torque produced by the downhole motors or turbine is quite variable. But these systems are unreliable for deeper wells.

This invention pertains to drilling full size drainholes with medium radius of curvature build intervals at much greater depths than previously used. The torque on the drill string and subs or housing and the orientation of the bit is much more difficult to control and maintain. For example, the resistance of axial angular deflection of 7000 feet of 2 ⅞ inch drill pipe held at the surface is only 0.8 ft-lbf per degree of curvature.

SUMMARY OF THE INVENTION

In this invention, a specially oriented drill collar of elliptic cross section is combined with a a conventional downhole motor and drill bit and with deflecting means adapted to urge or cause the bit to drill a borehole curving from 2° to 50° per hundred feet. The deflecting means may be any suitable means; but preferably, the deflecting means is comprised of a bent motor housing or a bent sub placed above or below the motor. In lieu thereof, the elliptic drill collar may be bent. The elliptic drill collar is oriented in a manner such that the minor axis of the ellipse lies generally in the direction the bit is pointed, that is, the direction of the intended curve of the build interval. For the desired vertical build, this places the locus of the minor axis of the ellipse toward the vertical and the locus of major axis toward the horizontal when the curved interval of the drainhole approaches horizontal. Preferably, the minor axis is at least twenty percent shorter than the major axis. Preferably, the drill collar is at least twenty feet long. An ellpitic drill collar combined and oriented in this manner will produce significant torsional resistance to rotation because the bending moment required to deflect the collar about its minimum axis is significantly less than with a collar deflected about its major axis. For example, a drill collar with a 3 inch by 4 inch elliptic section with a 2 inch internal diameter flow passage and a 90 foot length in a 20° per hundred feet medium curvature borehole, at small axial angular deflection generates a torque resistance of approximately 197 ft-lbf per degree. Contrast this with the 0.8 ft-lbf per degree previously mentioned. In one embodiment, the minor axis of the ellipse is oriented in a manner such that the minor axis is at an angle to the lateral direction that the bit is pointed as the assembly is lowered into the hole. This preloads the drill collar to resist reactions of the motor.

DESCRIPTION OF THE PREFERRED EMBODIMENTS

This invention concerns a drilling assembly of increased torsional resistance for drilling a drainhole of medium drift or azimuth change, that is, 2° to 50° per hundred feet. This angle refers to the change from the longitudinal axis of the wellbore or vertical. This angle is also commonly referred to as the angle build. This disclosure uses the simplest case of a curved wellbore in two dimensions where the vertical part of the well and the curved part remain in the same place. But it should be recognized that it rarely happens with real wells that main bore is perfectly straigth and truely vertical. The word vertical and horizontal, therefore, refer to the general or more apparent direction.

Figure 1:
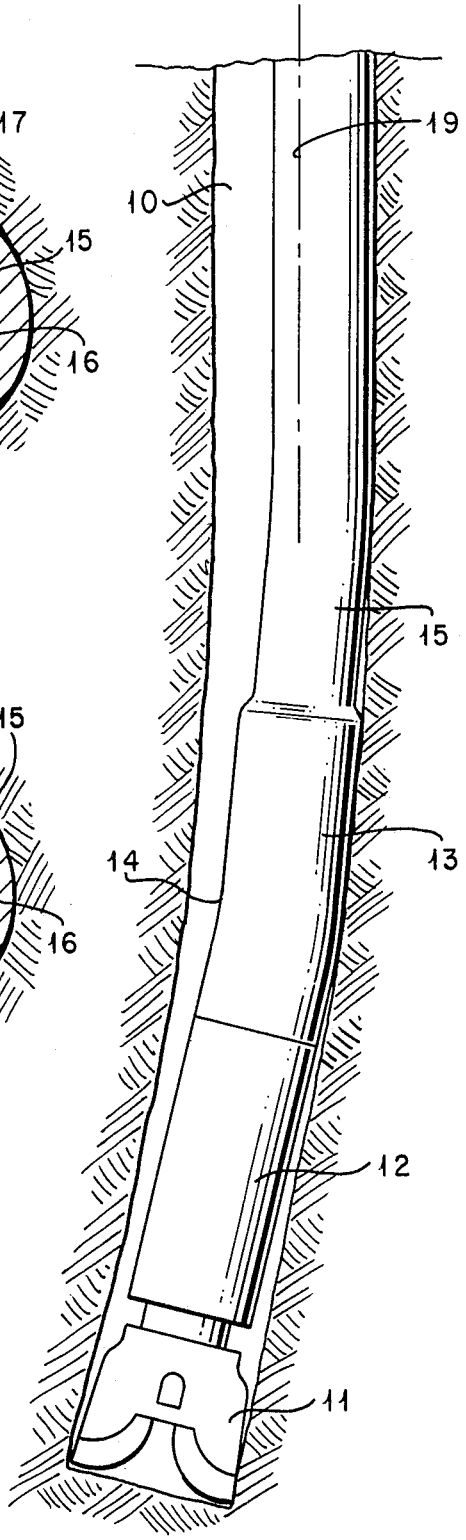
FIG. 1 illustrates a drainhole assembly with a bent sub and a specially oriented elliptically shaped drill collar drilling the curved interval in a preselected direction in a deep subsurface formation.

Accordingly, in FIG. 1, wellbore 10 has a vertical section and a curved interval extending to the left or west of vertical. The significance of this orientation for descriptional purposes will hereafter be made apparent. The curvature or dog leg is exaggerated for illustrative purposes. The curved part of the drainhole is being drilled or drilled and formed by drill bit 11. The bit is turned by motor 12 which is any sort of downhole motor, for example, a fluid driven turbine, which is suitable for turning the drill bit to drill borehole 10. The bit and motor are combined with deflecting means which is adapted to urge or cause the bit to drift in the build direction at a relatively controlled curve angle of 2° to 50° per hundred feet. The deflecting means may be any known sort of means adapted to deflect the bit, for example, springs loaded by forcing the drilling assembly into the borehole may be used. Preferably, as hereinafter described, the deflecting means is a bent means. The term bent includes means adapted to bend in a preset direction, for example, knuckle joints.

As shown in FIG. 1, the deflecting means is bent sub 13 which is connected to the upper end of motor 12. Bent sub 13 is bent at point 14. The sub may be a flexible knuckle member or a rigid member. Bent subs are known and are not described in detail. There may be as many lengths of curved or bent subs as is needed to form the curved interval of the drainhole. If the sub is located above the motor, the uppermost sub 13 will connect to special drill collar 15. Drill collar 15 is connected at its upper end to conventional members and drill pipes (not shown). The deflecting means, for example bent sub 13, and drill collar 15 are not planned to rotate with bit 11. They act as conductors and as a guide for forcing the bit to penetate out of the main hole in the build direction and follow a curving course toward horizontal.

Figure 2:
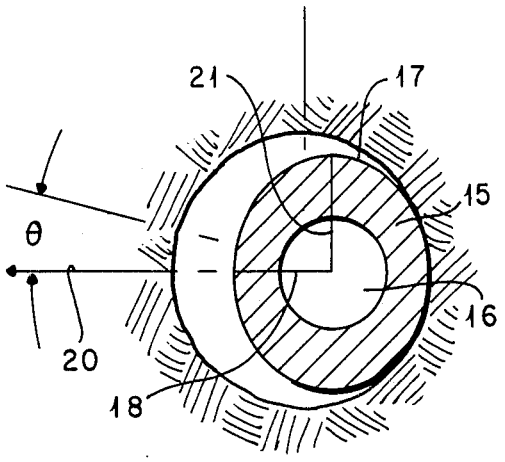
FIG. 2 shows an enlarged cross section of the elliptic drill collar of FIG. 1.

There are torsional forces on the drill collar created by various conditions including forces created by the motor and bit. These torsional forces on the drill collar vary in magnitude. Accordingly, a significant and essential feature of this invention is the shape and orientation of drill collar 15 which are illustrated in FIG. 2 wherein the drill collar has central cylindrical or oval shaped flow passage 16 and outer perimeter 17. Outer perimeter 17 is generally elliptic in shape with minor axis 18 lying in the direction or azimuth of build, that is, as shown oriented toward the left or west of longitudinal axis 19 of the vertical or main part of borehole 10 in the direction of curvature illustrated by arrow 20. This is the direction that the bit is pointed. Preferably the minor axis of the ellipse is at least twenty percent shorter than major axis 21 of elliptic drill collar 15. Preferably, the drill collar is at least 20 feet long. This special drill collar is shaped and oriented to create torsional resistance above the bit and stabilize the direction of build. As shown in the drawings, the shape and orientation also cause the elliptic drill collar to rest against the wall of the borehole opposite the direction of build or direction the drill bit is pointing. The torque resistance of the elliptic drill collar may be determined by the following general formula (1):

$$\frac{dT}{dL} = \frac{d}{d\theta}\left[EI_{xx}\frac{K_{x2}}{2} + EI_{yy}\frac{K_{y2}}{2}\right] \quad (1)$$

where K is the angle build, $K_x = K \cos\theta$ and $K_y = K \sin\theta$, T is torque resistance, L is length of the drill collar, $\theta$ is the angle of rotation, $I_{xx}$ is the moment inertia of the minor axis $D_x$ lying in the direction of curvature, $I_{yy}$ is the moment of inertia of the major axis $D_y$ which is perpendicular to $D_x$, and E is the modulous of elasticity of the drill collar material. The angle $\theta$ is shown in FIG. 2 and is the angle that minor axis 18 rotates from direction 20 of the build portion of the borehole, that is, the borehole that is the direction in which the drill bit is pointed. If the angle of rotation or twist is negligible, formula (1) may be converted to the following formula (2):

$$T \approx EL\,K^2(I_{yy} - I_{xx}) \sin\theta \cos\theta \quad (2)$$

For $\theta$ less than 6°, formula (2) may be simplified to the following formula (3):

$$T \approx ELK^2(I_{yy} - I_{xx})\theta \quad (3)$$

If T is expressed in ft-lbf, E in psi, L in feet, K in degrees per 100 feet, $\theta$ in degrees, and $I_{yy}$ and $I_{xx}$ in $(\text{inch})^4$, formula (3) may be written as follows:

$$T \approx 4.43 \times 10^{-11} ELK^2(I_{yy} - I_{xx})\theta \quad (4)$$

Using formula (4) and assuming K=20°/100 ft, $D_x$=3", $D_y$=4", the ID of the flow passage =2", L=90', $I_{xx}$=5.05 in.$^4$, $I_{yy}$=9.18 in$^4$, then T equals approximately (197 $\theta$) ft-lbf. By way of further illustration if K=6°/100 ft, $D_x$=4", $D_y$=7", $I_{xx}$=21.2 in$^4$ and $I_{yy}$=66.6 in$^4$, then T is approximately equal to (195 $\theta$) ft-lbf.

Figure 3:
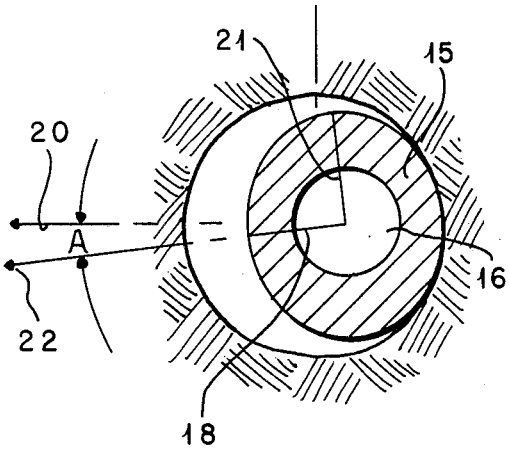
FIG. 3 shows an enlarged cross section of a slightly misaligned drill collar.

In the embodiment of FIG. 3, minor axis 18 of elliptic drill collar 15 is deliberately misaligned at a reactively small angle A of less than 10° with direction 20. This misalignment is illustrated by direction 22 and adapts the drill collar to generate a torque that offsets the reaction of motor 12 during drilling.

Figure 4:
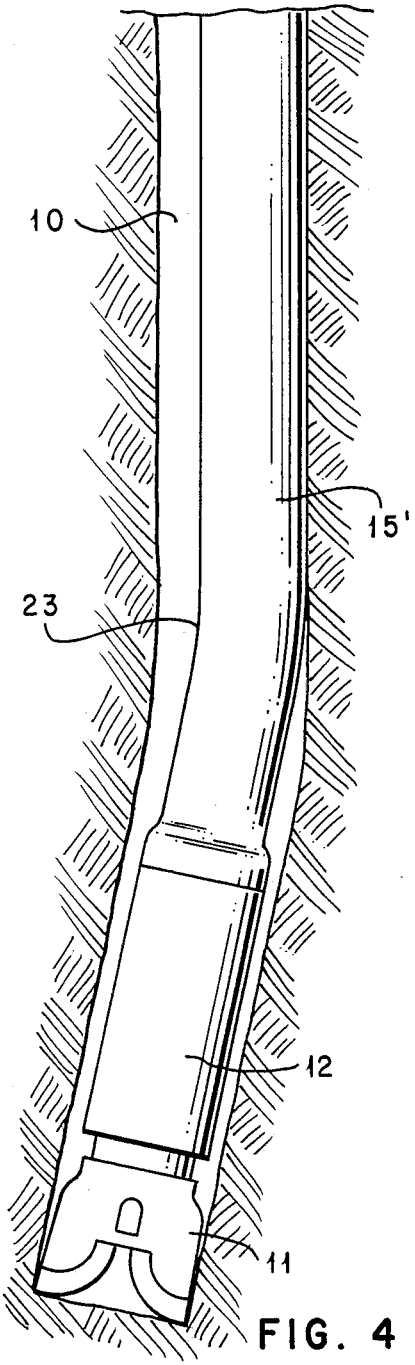
FIG. 4 shows a bent elliptically shaped drill collar.

In FIG. 4, the separate bent sub 13 is omitted. In this embodiment, drill collar 15' which is appropriately bent at point 23 or is formed of a flex joint(s) to urge the bit in the desired build direction at the desired angle of curvature. The elliptic perimeter and minor axis of drill collar 15' are orientated as previously described. A separate bent sub is preferred over a bent drill collar.

Figure 5:
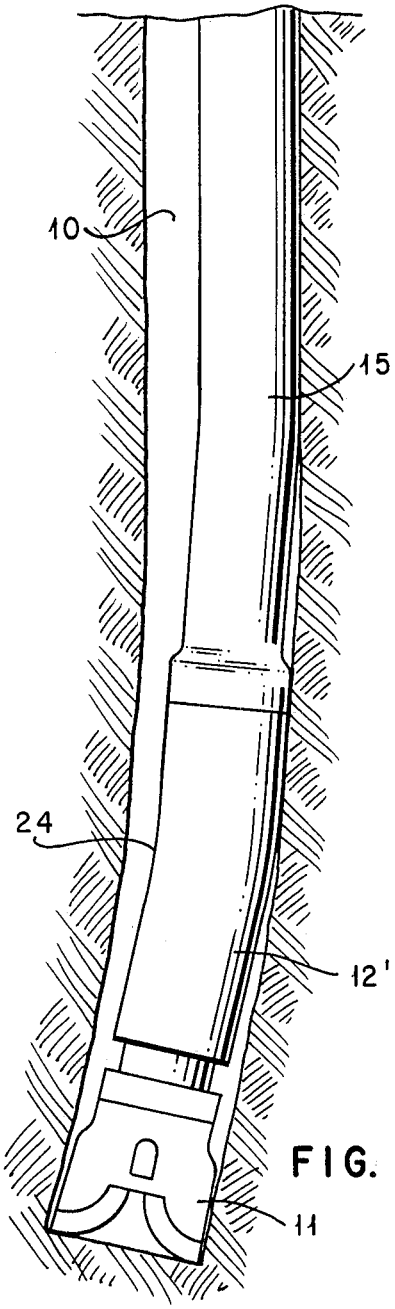
FIG. 5 shows a bent downhole motor housing.

In FIG. 5, separate bent sub 13 is omitted. In this embodiment, the deflecting means is formed by the housing of motor 12'. The housing is bent at point 24. Bent housings and their stationary or nonrotational characteristics are known to the art and are not described herein in detail. A bent housing is preferred over a bent sub placed above the motor because it is desirable to have the bit and deflecting means as close to each other as is practical.

In operation, a main or vertical borehole is drilled in conventional manner to the point where the hole is to be deviated into a drainhole. At this time, drill bit 11 is connected to motor 12. If the deflecting means is placed below the motor, then the bit will be connected to a cylindrical shaft connected to the motor and the deflecting means will be placed around the shaft in typical bearing fashion so that it does not rotate with the bit. If a bent housing is used, the bent housing will not rotate with the bit. The motor, therefore, may be connected to either bent sub 13, or drill collar 15, or bent drill collar 15' or to intermediate members. If bent sub 13 is used and is placed above the motor, the uppermost end of the sub is then connected to the drill collar with or without intermediate members. If desired, a whipstock may be lowered and oriented in the borehole first and set at the desired location. The drilling assembly is lowered into the borehole to the desired point with the deflecting means and drill collar oriented in the preselected direction. The elliptic drill collar with or without predetermined misalignment resists twisting and disorientation of the drill bit. When drilling is renewed and weight is placed on the bit by the drill string or drill collar, the deflecting means (with or without the aid of a whipstock) urges the bit to penetate out of the mainhole toward the desired azimuth of curvature. As the bit is rotated, it cuts a side pocket in the vertical bore and the drilling assembly is steered by the line of axis of the bit and deflecting means. As weight is maintained on the bit by feeding drill string into the bore at the surface, the bit is crowded outward and downward out of the original hole due to side pressure caused by the bent sub or bent drill collar (with or without the whipstock). The deflecting means and drill collar follow the bit into the deviated curving borehole. The deflecting means and the drill collar are not rotated. They may be used to conduct fluid to motor 12 and drill bit 11. The drill collar with its specially oriented elliptic shape and if the embodiment of FIG. 3 is used, its predetermined misalignment resists torque forces created by the drill bit and downward forces of the drill string. This adds stability to the system and reduces chances of over drilling either right or left of the intended target.

Various embodiments and modifications of this invention have been described in the foregoing description and examples, and further modifications will be apparent to those skilled in the art. Such modifications are included within the scope of this invention as defined by the following claims.

We claim:

1. An assembly adapted to be connected to a drill pipe for drilling a curved borehole in the earth from a main borehole comprising a downhole motor means adapted to turn a drill bit; drill bit means adapted to be turned by said motor means; deflecting means adapted to urge said drill bit to drill a borehole curving from the longitudinal axis of said main borehole in a relatively constant predetermined direction at a rate of between 2° and 50° per hundred feet, and a drill collar having a generally elliptically shaped outer perimeter with the minor axis of said elliptically shaped drill collar oriented to lie generally in said predetermined direction of curvature with said elliptically shaped drill collar in engagement with the wall of said borehole and to be nonrotatably disposed in said borehole so as to stabilize the direction of penetration of said bit in said predetermined direction when said bit is lowered into said main borehole to the point where said curving bore deviates from the longitudinal axis of said main borehole.

2. The assembly of claim 1 wherein the drill collar is at least 20 feet long.

3. The assembly of claim 1 wherein the length of said minor axis of said elliptically shaped drill collar is at least twenty percent less than the length of the major axis of said elliptically shaped drill collar.

4. The assembly of claim 3 wherein said elliptically shaped drill collar is at least 20 feet long.

5. The assembly of claim 1 wherein the deflecting means is comprised of a bent housing for said motor means.

6. The assembly of claim 5 wherein the drill collar is at least 20 feet long.

7. The assembly of claim 5 wherein the length of said minor axis of said elliptically shaped drill collar is at least twenty percent less than the length of the major axis of said elliptically shaped drill collar.

8. The assembly of claim 7 wherein said elliptically shaped drill collar is at least 20 feet long.

9. The assembly of claim 1 wherein the deflecting means is comprised of a bent sub means.

10. The assembly of claim 9 wherein the drill collar is at least 20 feet long.

11. The assembly of claim 9 wherein the length of said minor axis of said elliptically shaped drill collar is at least twenty percent less than the length of the major axis of said elliptically shaped drill collar.

12. The assembly of claim 11 wherein said elliptically shaped drill collar is at least 20 feet long.

13. The assembly of claim 1 wherein the deflecting means is comprised of a bent portion of said elliptically shaped drill collar.

14. The assembly of claim 13 wherein said ellipitically shaped drill collar is at least 20 feet long.

15. The assembly of claim 13 wherein the length of said minor axis of said elliptically shaped drill collar is at least twenty percent less than the length of the major axis of said elliptically shaped drill collar.

16. The assembly of claim 15 wherein said elliptically shaped drill collar is at least 20 feet long.

17. The assembly of claim 1 wherein the minor axis of said elliptically shaped drill collar is placed at a relatively small angle of rotation to said predetermined direction.

18. The assembly of claim 17 wherein said elliptically shaped drill collar is at least 20 feet long.

19. The assembly of claim 17 wherein the length of said minor axis of said elliptically shaped drill collar is at least twenty percent less than the length of the major axis of said elliptically shaped drill collar.

20. The assembly of claim 19 wherein said elliptically shaped drill collar is at least 20 feet long.

21. The assembly of claim 17 wherein the deflecting means is comprised of a bent housing for said motor means.

22. The assembly of claim 21 wherein said elliptically shaped drill collar is at least 20 feet long.

23. The assembly of claim 21 wherein the length of said minor axis of said elliptically shaped drill collar is at least twenty percent less than the length of the major axis of said elliptically shaped drill collar.

24. The assembly of claim 23 wherein said elliptically shaped drill collar is at least 20 feet long.

25. The assembly of claim 17 wherein the deflecting means is comprised of a bent sub means.

26. The assembly of claim 25 wherein said elliptically shaped drill collar is at least 20 feet long.

27. The assembly of claim 25 wherein the length of said minor axis of said elliptically shaped drill collar is at least twenty percent less than the length of the major axis of said elliptically shaped drill collar.

28. The assembly of claim 27 wherein said elliptically shaped drill collar is at least 20 feet long.

29. The assembly of claim 17 wherein the deflecting means is comprised of a bent portion of said elliptically shaped drill collar.

30. The assembly of claim 29 wherein said elliptically shaped drill collar is at least 20 feet long.

31. The assembly of claim 29 wherein the length of said minor axis of said elliptically shaped drill collar is at least twenty percent less than the length of the major axis of said elliptically shaped drill collar.

32. The assembly of claim 31 wherein said elliptically shaped drill collar is at least 20 feet long.

33. An assembly adapted to be connected to a drill pipe for drilling a curved borehole in the earth from a main borehole comprising a downhole motor means adapted to turn a drill bit; drill bit means adapted to be turned by said motor means; means interposed in said assembly to provide for urging said drill bit to drill a borehole curving from the longitudinal axis of said main borehole in a relatively constant predetermined direction, and a member interposed in said assembly between said bit and said drill pipe and having a generally noncircular shaped outer perimeter defining major and minor axis, said minor axis of said noncircular shaped member being oriented to lie generally in said predetermined direction of curvature with said noncircular shaped member in engagement with the wall of said borehole, and said noncircular shaped member being nonrotatably disposed in said borehole so as to stabilize the direction of penetration of said bit in said predetermined direction when said bit is lowered into said main borehole to the point where said curving bore deviates from the longitudinal axis of said main borehole.

34. An assembly adapted to be connected to a drill pipe for drilling a curved borehole in the earth from a main borehole comprising downhole motor means adapted to turn a drill bit; drill bit means adapted to be turned by said motor means; means interposed in said assembly to provide for urging said drill bit to drill a borehole curving from the longitudinal axis of said main borehole in a relatively constant predetermined direction, and a member interposed in said assembly between said bit and said drill pipe and having a cross sectional shape forming at least one axis of symmetry, said axis of symmetry being oriented to lie generally in said predetermined direction of curvature with said member in engagement with the wall of said borehole, and said member being nonrotatably disposed in said borehole so as to stabilize the direction of penetration of said bit in said predetermined direction during drilling of said curved borehole.

* * * * *